US008419167B2

(12) United States Patent
Miyazaki et al.

(10) Patent No.: US 8,419,167 B2
(45) Date of Patent: Apr. 16, 2013

(54) LIQUID DISCHARGE HEAD AND LIQUID DISCHARGE APPARATUS

(75) Inventors: Kyota Miyazaki, Tama (JP); Toshiaki Hirosawa, Hiratsuka (JP); Hiroki Tajima, Yokohama (JP); Akira Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 121 days.

(21) Appl. No.: 13/104,766

(22) Filed: May 10, 2011

(65) Prior Publication Data

US 2011/0279549 A1 Nov. 17, 2011

(30) Foreign Application Priority Data

May 14, 2010 (JP) ..... 2010-112363

(51) Int. Cl.
*B41J 2/14* (2006.01)
*B41J 2/16* (2006.01)

(52) U.S. Cl.
USPC ..... 347/50; 347/58

(58) Field of Classification Search ..... 347/20, 347/54, 56–59, 49
See application file for complete search history.

(56) References Cited

U.S. PATENT DOCUMENTS 6,382,858 B1 * 5/2002 Nojima et al. ..... 400/691
2002/0109751 A1 8/2002 McElfresh et al.

* cited by examiner

*Primary Examiner* — Juanita D Jackson
(74) *Attorney, Agent, or Firm* — Canon USA Inc. IP Division

(57) ABSTRACT

A liquid discharge head includes a recording element substrate including a recording element that generates energy for discharging liquid from a discharge port, a base plate including a mounted surface on which the recording element substrate is mounted, an electric wiring substrate including a portion disposed on another surface of the base plate different from the mounted surface, adjacent to the mounted surface, and configured to be electrically connected to the recording element substrate, and an shield member having electric conductivity and configured to shield the portion.

9 Claims, 18 Drawing Sheets

LIQUID DISCHARGE HEAD AND LIQUID DISCHARGE APPARATUS

BACKGROUND OF THE INVENTION

1. Field of the Invention

The present invention relates to a liquid discharge head and a liquid discharge apparatus that discharge a liquid.

2. Description of the Related Art

A typical inkjet recording head (hereinafter, also referred to as a "recording head") as a liquid discharge head that discharges a liquid includes a recording element substrate provided with recording elements that generate energy for discharging an ink from discharge ports. Further, the recording head includes a power source for driving the recording elements, and an electric wiring substrate for supplying a signal for driving the recording elements from the outside to the recording element substrate.

When a number of the recording elements is increased in order to improve an image quality, a number of signals for driving the recording element substrate increases, and a number of wirings within the electric wiring substrate increases. In addition, as discussed in US Patent Application Publication No. 2002/0109751, a full-line type recording head having a print width comparable with a width of the recording medium may have an increased number of the recording elements, in order to adapt to the print width, and in such a case as well, a number of wirings within the electric wiring substrate increases.

Now, static electricity is generated by friction between a conveying mechanism provided in the inkjet recording apparatus for conveying a recording medium and a recording medium on which discharged ink is recorded. There is a risk that static electricity is discharged to the electric wiring substrate. At this time, if static electricity is discharged to signal wiring for supplying signals for driving the recording head, then noise is generated, and signals different from the signals necessary for desired recording are input into the recording elements, and desired ink discharge is not performed, thereby possibly leading to degraded image quality.

In particular, in a configuration in which there is a number of wirings within the electric wiring substrate, or in a configuration in which the inkjet recording head is located close to a noise source such as a conveying mechanism of the recording medium, there is much higher risk of being affected by the above-described noise.

SUMMARY OF THE INVENTION

The present invention is directed to a liquid discharge head and a liquid discharge apparatus that is insusceptible to noise, and capable of suppressing degradation of image quality due to noise.

According to an aspect of the present invention, a liquid discharge head includes a recording element substrate including a recording element that generates energy for discharging liquid from a discharge port, a base plate including a mounted surface on which the recording element substrate is mounted, an electric wiring substrate including a portion disposed on another surface of the base plate different from the mounted surface, adjacent to the mounted surface, and configured to be electrically connected to the recording element substrate, and an shield member having electric conductivity and configured to shield the portion.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 1A is an external perspective view of the recording head, FIG. 1B is an underside view of the recording head, and FIG. 1C is an exploded perspective view of the recording head.

FIGS. 3A and 3B are explanatory views of a recording element substrate, wherein FIG. 3A is an external perspective view of the recording element substrate, and FIG. 3B is a cross-sectional view taken along a line A-A of FIG. 3A.

FIGS. 4A, 4B, and 4C are explanatory views of a base plate, wherein FIG. 4A is an external perspective view including a surface on which the recording element substrate is arranged (mounted surface), FIG. 4B is an external perspective view including a surface on which ink inflow ports and outflow ports are provided, and FIG. 4C is a plan view illustrating internal ink flow paths transparently, as viewed from a surface on which the recording element substrate is arranged.

FIGS. 11A and 11B illustrate the recording apparatus in a state where the recording head to which the present invention can be applied is mounted, wherein FIG. 11A is a plan view as viewed from an "X" direction of FIG. 9, and FIG. 11B is a plan view including a cross-section taken along a line of B-B of FIG. 11A.

FIGS. 14A and 14 B are schematic views of proximity of a side plate, of the recording element unit illustrated in FIG. 13, wherein FIG. 14A illustrates a state where the side plate is attached.

FIGS. 15A and 15B are schematic cross-sectional views in the proximity of a discharge surface, of the recording element unit illustrated in FIG. 13, wherein FIG. 15A illustrates a first exemplary embodiment, and FIG. 15B illustrates a modification thereof.

DESCRIPTION OF THE EMBODIMENTS

Various exemplary embodiments, features, and aspects of the invention will be described in detail below with reference to the drawings.

The typical inkjet recording head as the liquid discharge head to which the present invention can be applied will be described by way of example. FIGS. 1A, 1B, and 1C through FIGS. 11A and 11B are diagrams illustrating configurations of the recording head, and the inkjet recording apparatus on which the recording head is mounted (hereinafter, referred to as a "recording apparatus").

(1) Recording Head

Figure 1A:
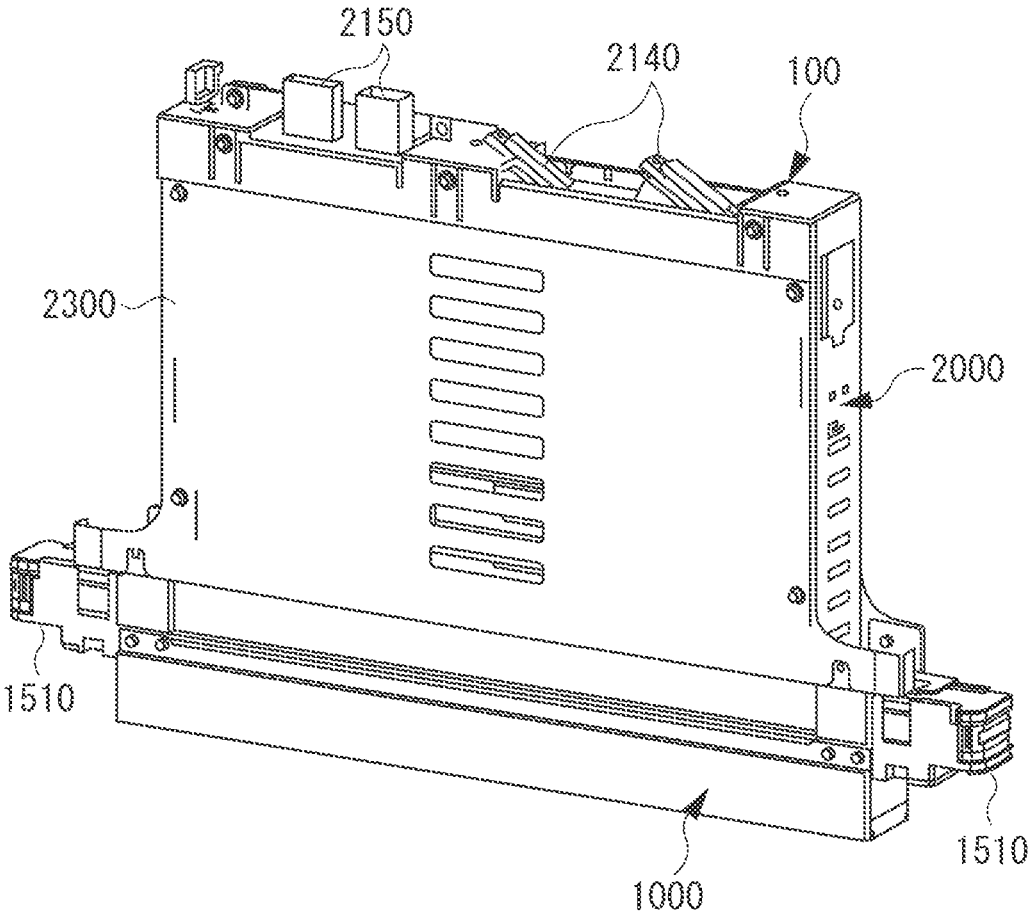
FIGS. 1A, 1B, and 1C are explanatory views of a recording head to which the present invention can be applied.
Figure 1B:
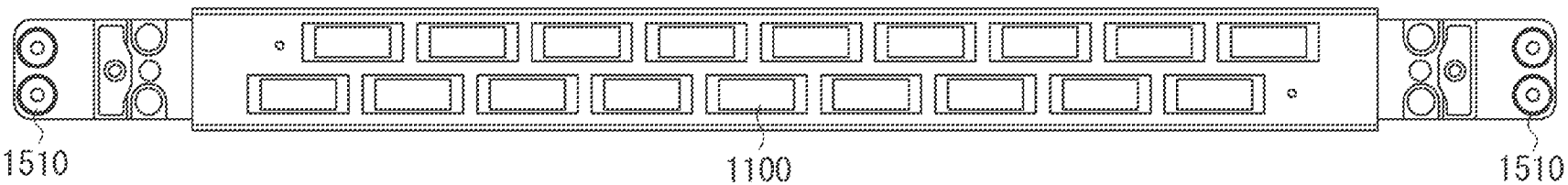
Figure 1C:
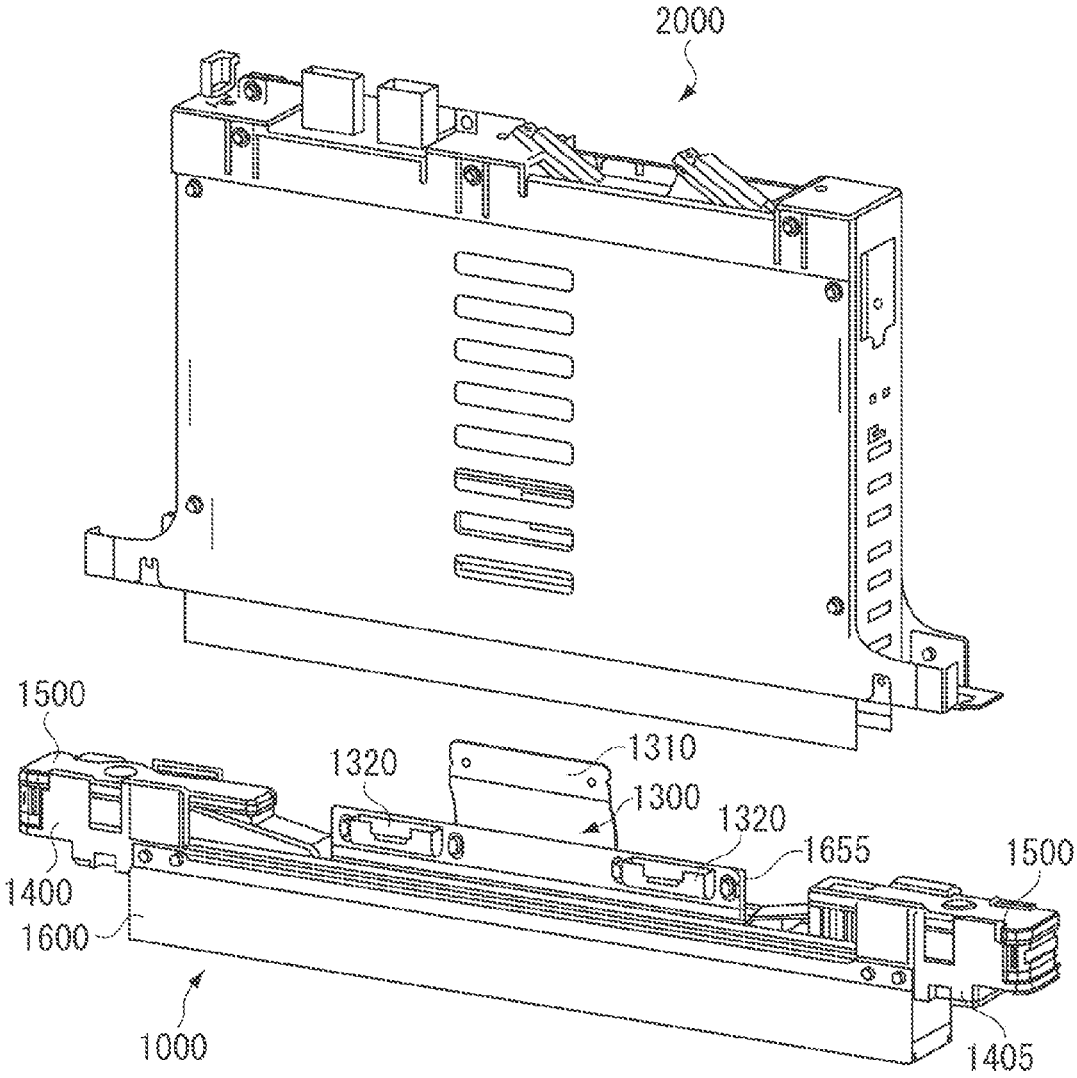

FIGS. 1A to 1C illustrate a configuration of a recording head 100 to which the present invention can be applied. The recording head 100 is a full-line type recording head 100 in which recording element substrates 1100 having discharge ports are arranged over a range corresponding to a maximum width of a recording sheet such as paper to be used, and thus recording can be performed at a high speed without the need to move the recording head 100 to scan recording sheet.

As illustrated in FIG. 1C, the recording head 100 includes a recording element unit 1000 and a drive circuit substrate unit 2000. The recording element unit 1000 and the drive circuit substrate unit 2000 are mechanically and electrically detachably combined with each other.

<Recording Element Unit>

Figure 2:
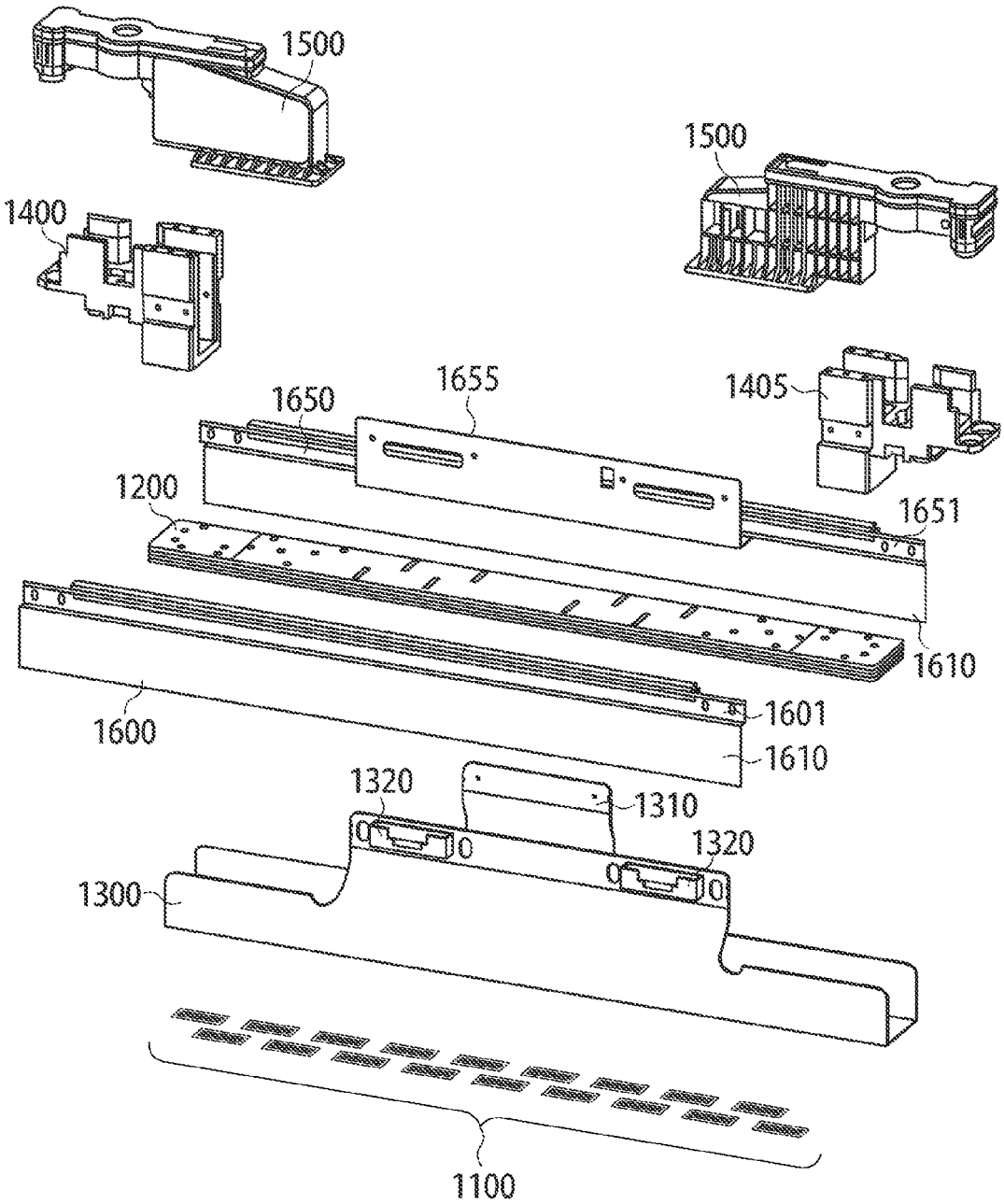
FIG. 2 is an exploded perspective view of the recording element unit.

FIG. 2 is an exploded perspective view illustrating the recording element unit 1000. The recording element unit 1000 includes a plurality of recording element substrates 1100, a base plate 1200, two supporting members 1400 and 1405, two ink supply members 1500, an electric wiring substrate 1300, and two side plates 1600 and 1650.

The plurality of recording element substrates 1100 are disposed and mounted on the mounted surface 1200A of the base plate 1200, accurately and in a staggered pattern with respect to a longitudinal direction of the base plate 1200. Two supporting members 1400 and 1405, and two ink supply members 1500 are secured at both ends with respect to the longitudinal direction of the base plate 1200. The electric wiring substrate 1300 is bonded and secured to the base plate 1200, and both ends of a lateral direction of the electric wiring substrate 1300 are bent.

Figure 3A:
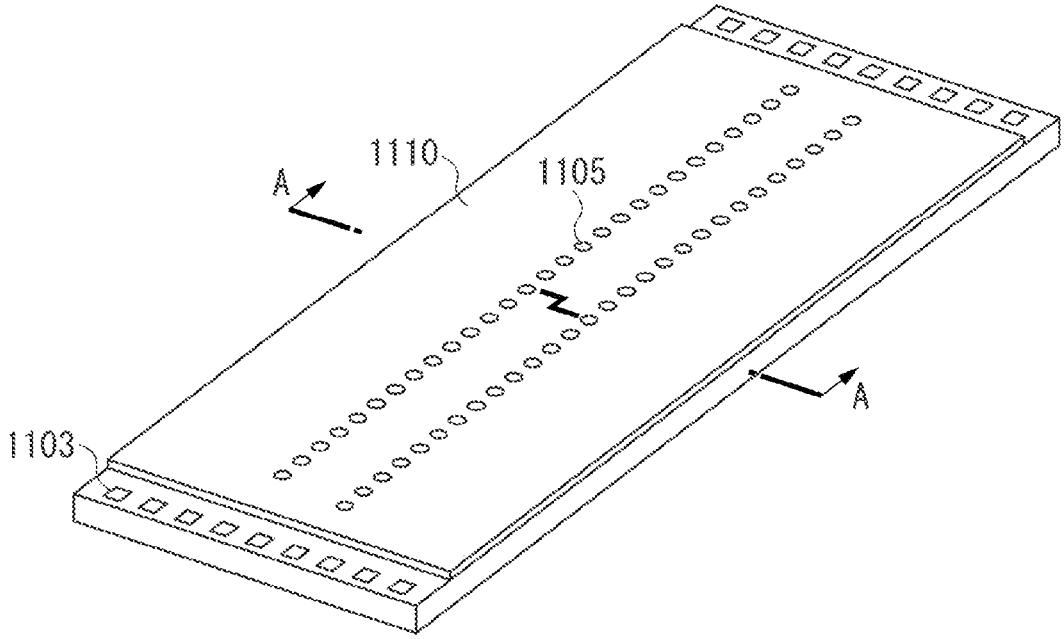
Figure 3B:
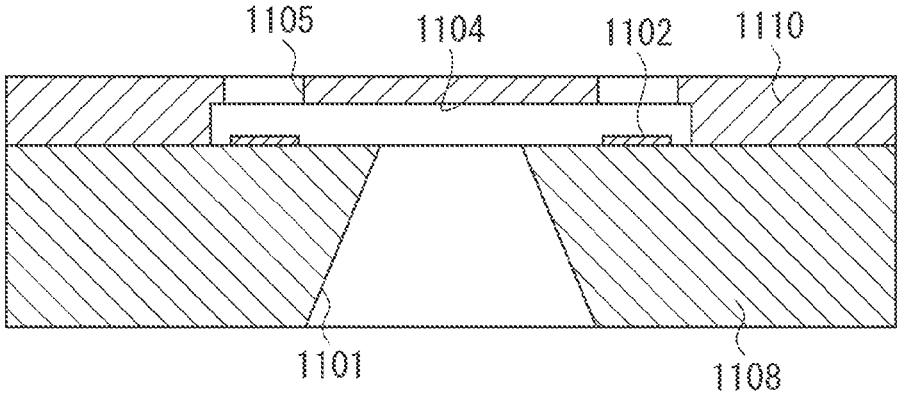

Next, a configuration of the recording element unit 1000 will be described in more detail. First, a configuration of the recording element substrate 1100 is illustrated in FIGS. 3A and 3B. The recording element substrate 1100 is composed of a silicon substrate 1108 and a discharge port plate 1110.

A thickness of the silicon substrate 1108 is about 0.5 to 1 mm. In the silicon substrate 1108, a long groove-shaped ink supply port 1101 extending along a longitudinal direction of the silicon substrate 1108 is formed. On both ends of the ink supply port 1101, electrothermal conversion elements 1102 such as a heater serving as recording elements that generate energy for discharging the ink are arranged in a staggered pattern for each one row.

The electrothermal conversion elements 1102, and electric wiring (not illustrated) such as aluminum electrically connected to the electrothermal conversion elements 1102 are formed using film-forming technique. Further, electrodes 1103 electrically connected to the electric wiring substrate 1300 are provided at both ends, in the longitudinal direction, of the recording element substrate 1100.

On the silicon substrate 1108, the discharge port plate 1110 composed of resin materials is provided. On the discharge port plate 1110, the ink flow paths 1104 and the discharge ports 1105 corresponding to the electrothermal conversion elements 1102 are formed using photolithography technique.

The discharge ports 1105 are provided opposing to the electrothermal conversion elements 1102. More specifically, the discharge ports 1105 are disposed along the longitudinal direction of the recording element substrate 1100. By producing air bubbles by driving the electrothermal conversion elements 1102, the ink supplied from the ink supply ports 1101 is discharged from the discharge ports 1105.

Figure 4A:
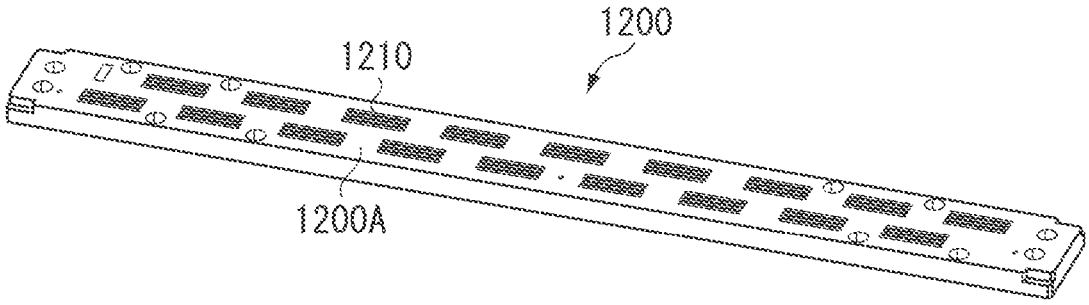
Figure 4B:
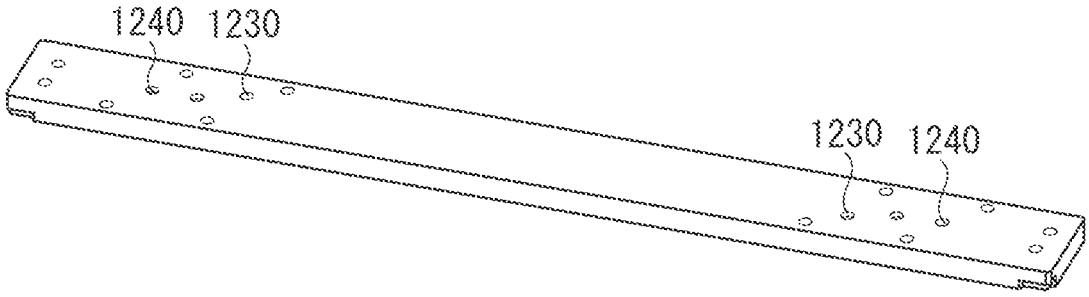
Figure 4C:
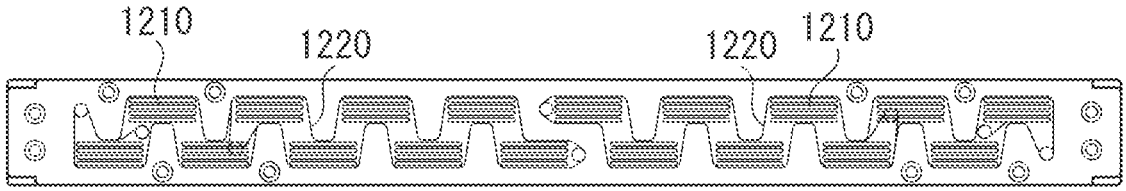

Next, a configuration of the base plate 1200 is illustrated in FIGS. 4A to 4C. The base plate 1200 is formed by laminating and burning a plurality of alumina green sheets formed of aluminum oxide ($Al_2O_3$; hereinafter, referred to as alumina).

A thickness of the alumina green sheets is about 0.5 to 1 mm, and a thickness of the base plate 1200 formed by laminating the alumina green sheets is about 10 mm. On the base plate 1200, ink supply slits 1210 for supplying ink to the ink supply ports 1101 of the recording element substrate 1100, and ink flow paths 1220 for supplying the ink from an ink tank (not illustrated) to the ink supply slits 1210 are formed.

In the present exemplary embodiment, alumina is used as a material of the base plate 1200, but the material is not limited to this. It is only necessary for the material of the base plate 1200 to have a coefficient of linear expansion of about the same value as that of a material of a member which contacts the base plate 1200, of the recording element substrate 1100, and to have a coefficient of thermal conductivity of about the same value, or greater than that of the material.

Examples of the materials of the base plate 1200 include silicon (Si), aluminum nitride (AlN), zirconia ($ZrO_2$), silicon nitride ($Si_3N_4$), silicon carbide (SiC), and molybdenum (Mo), and tungsten (W).

Figure 5:
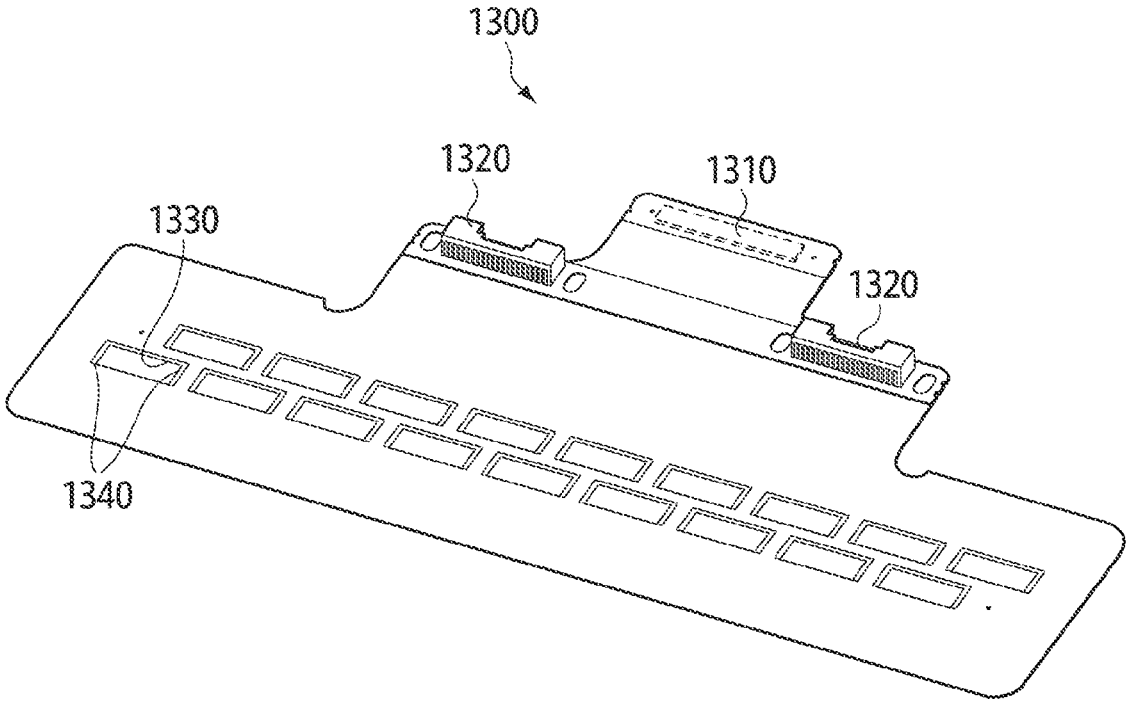
FIG. 5 is an external perspective view of the electric wiring substrate.
Figure 6A:
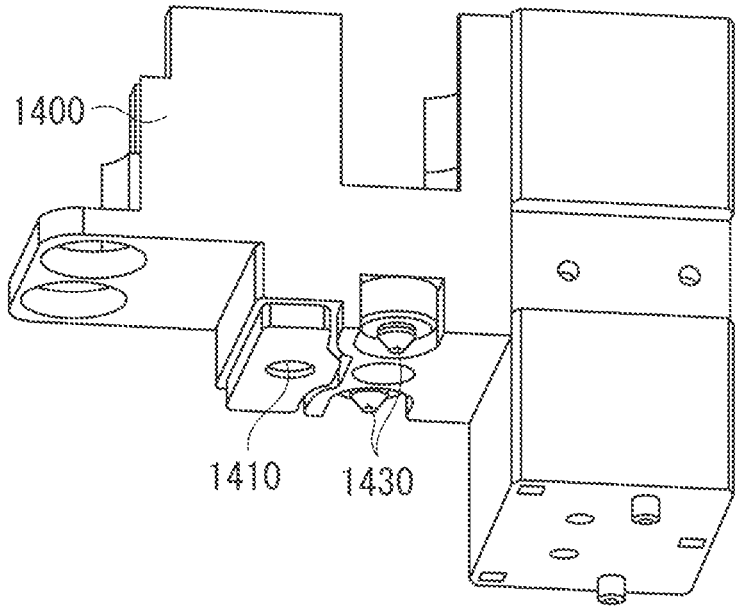
FIGS. 6A and 6B are external perspective views illustrating supporting members.
Figure 6B:
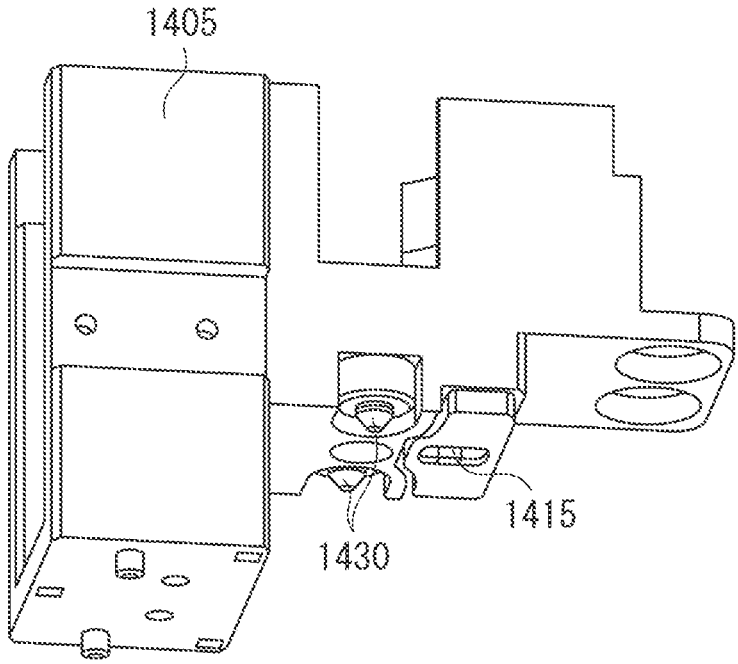

FIG. 5 illustrates a configuration of the electric wiring substrate 1300. The electric wiring substrate 1300 is a member that transmits signals for driving the electrothermal conversion elements 1102 sent from the recording apparatus 3000 (see FIG. 10), to the recording element substrates 1100, and supplies electric power for driving the electrothermal conversion elements 1102 to the recording element substrates 1100.

The electric wiring substrate 1300 is a flexible wiring substrate in which wiring patterns are formed on a resin film (film member). The electric wiring substrate 1300 has a plurality of opening portions 1330 for incorporating the recording element substrates 1100 therein. Electrode terminals 1340 corresponding to electrodes 1103 of the recording element substrate 1100 are formed at both ends of each of the plurality of opening portions 1330.

The electric wiring substrate 1300 is bonded and secured to a surface, on which the ink supply slits 1210 are formed, of the base plate 1200. The electric wiring substrate 1300 includes an electric signal connecting portion 1310 for receiving electric signals for driving the recording head 100 from the recording apparatus 3000, and power source connecting portions 1320 for receiving electric power from the recording apparatus 3000.

The electric wiring substrate 1300 and the electrothermal conversion elements 1102 are electrically connected by joining the electrodes 1103 of the recording element substrate 1100 and the electrode terminals 1340 of the electric wiring substrate 1300 by, e.g., wire bonding technique using metal wires (not illustrated). Then, the electrodes 1103 of the recording element substrates 1100, and the electrode terminals 1340 of the electric wiring substrate 1300, and wires are covered with sealing compound, and protected from corrosions caused by ink or external shocks.

FIG. 6 illustrates a configuration of a supporting member A 1400 and a supporting member B 1405. The two supporting members 1400 and 1405 are members for securing the recording head 100 to the recording apparatus 3000, and are secured each at both ends in the longitudinal direction of the base plate 1200.

In each of the supporting members 1400 and 1405, formed are a positioning hole A 1410 and a positioning hole B 1415 which is fit with positioning pins 3430 (see FIGS. 11A and 11B) provided in the recording apparatus 3000, when the recording head 100 is mounted onto the recording apparatus 3000. Two positioning holes 1410 and 1415 are used to mount the recording head 100 at an appropriate position with respect to a lateral direction ("X" direction illustrated in FIG. 9) of the recording head 100 and a longitudinal direction ("Y" direction illustrated in FIG. 9) of the recording head 100.

The positioning hole A 1410 for the supporting member A 1400 is a circular hole, and the positioning hole B 1415 for the supporting member B 1405 is a long hole. Further, positioning portions 1430 are formed, which abuts head holders 3400 (see FIGS. 11A and 11B) supporting the recording head 100, when the recording head 100 is mounted onto the recording apparatus 3000. The positioning portions 1430 are members for keeping an interval constant between the recording sheet and a surface of the side on which the discharge ports 1105 on the recording element substrate 1100 are provided. A configuration of side plates 1600 and 1650 will be described in the first and the second exemplary embodiments described below.

Figure 7:
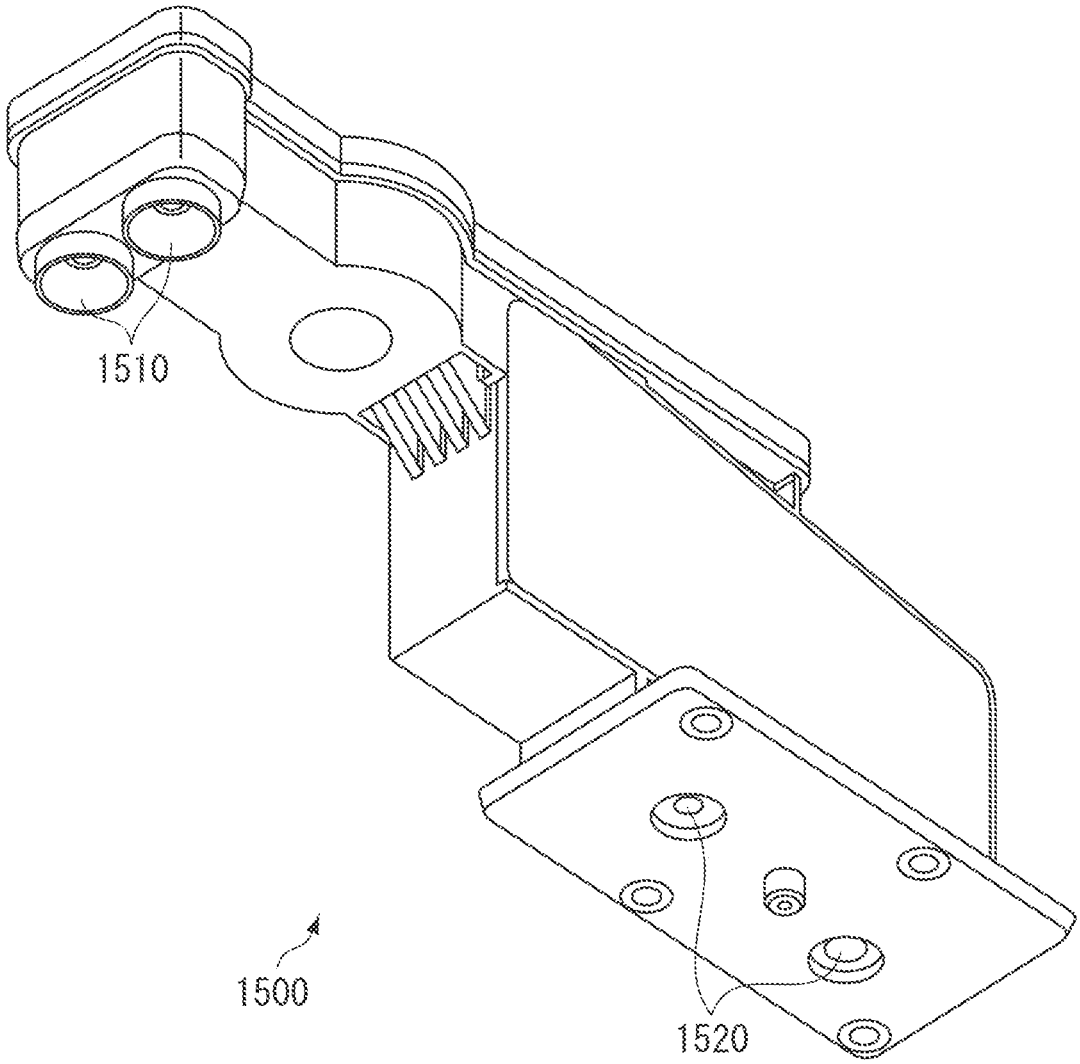
FIG. 7 is an external perspective view illustrating an ink supply member.

FIG. 7 illustrates a configuration of an ink supply member 1500. The ink supply member 1500 is connected to connecting units 3410 (see FIG. 11A) of the recording apparatus 3000 side, and supplies ink from the recording apparatus 3000 to the recording element unit 1000. The ink supply members 1500 are formed of, e.g., resin materials, and are provided with two connecting portions 1510 connected to the recording apparatus 3000, and two opening portions 1520 connected to the base plate 1200.

The two connecting portions 1510 and two opening portions 1520 are provided thereon, for circulating the ink between the recording apparatus 3000 and the recording element unit 1000.

Inside the ink supply member 1500, the ink flow paths (not illustrated) which connect the connecting portions 1510 and the opening portions 1520 are provided, and a filter (not illustrated) for removing foreign substances or air bubbles mixed into the ink is arranged at some midpoint in the ink flow paths. Then, joint rubbers for joining with ink supply pipes of the recording apparatus 3000 are attached to the connecting portions 1510, and the connecting portions 1510 are connected to the connecting units 3410 of the recording apparatus 3000.

The ink supply member 1500 is positioned relative to the base plate 1200, so that the opening portions 1520 communicate with the ink inflow ports 1230 and the outflow ports 1240 (see FIG. 4) formed near the end portions of the base plate 1200.

<Drive Circuit Substrate Unit>

Figure 8:
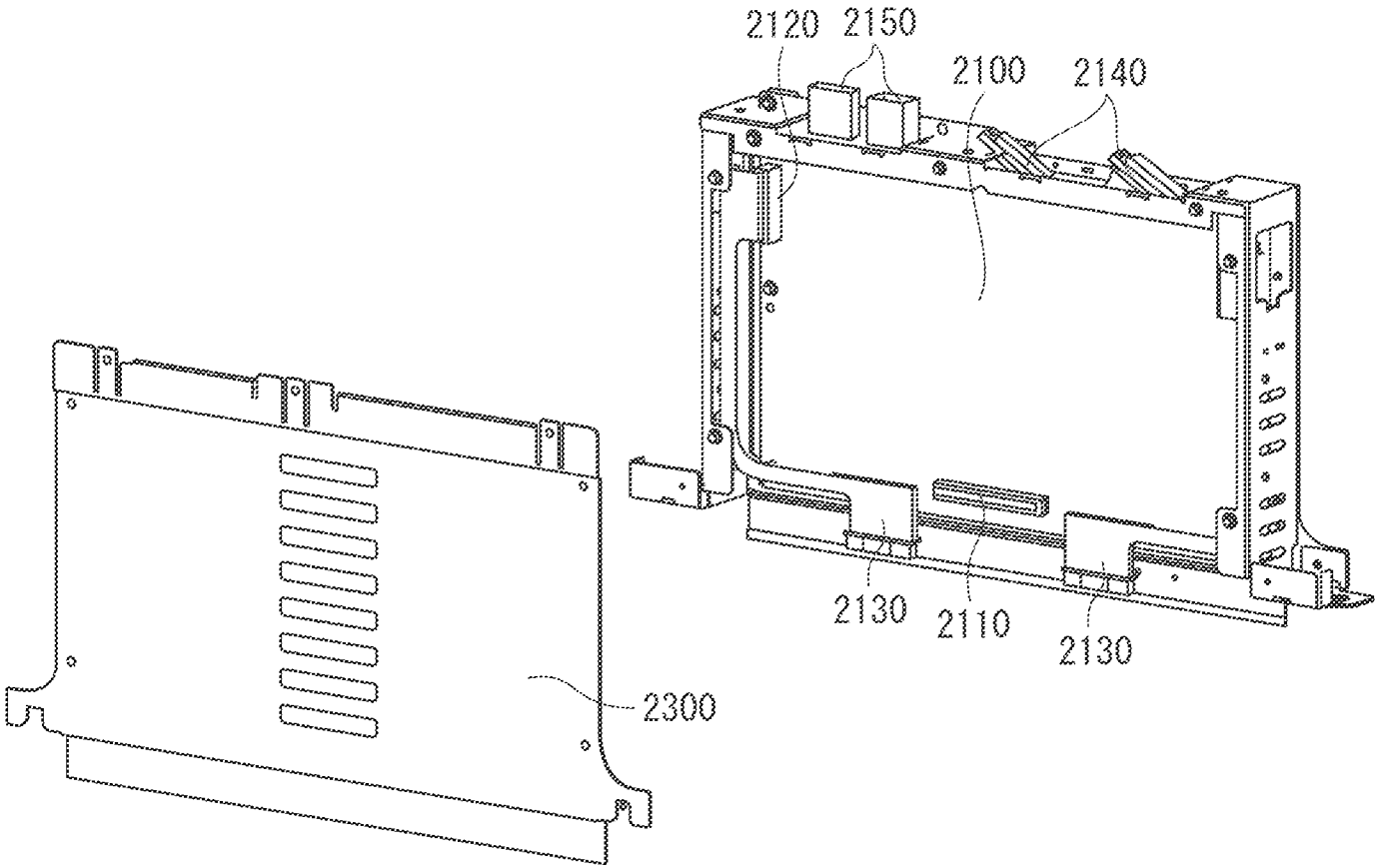
FIG. 8 is an exploded perspective view illustrating a drive circuit substrate unit.

FIG. 8 illustrates a configuration of a drive circuit substrate unit 2000. FIG. 8 illustrates a state where a cover 2300 is removed.

Inside the drive circuit substrate unit 2000, a drive circuit substrate 2100 for controlling discharge drive of the recording head 100 is accommodated and secured. In the drive circuit substrate 2100, an electric signal connector 2110 electrically connected to the electric signal connecting portion 1310 provided in the electric wiring substrate 1300 of the recording element unit 1000, and a power source connector 2120 for performing power supply to the recording element unit 1000 are arranged.

Then, the power source connector 2120 at the drive circuit substrate 2100 side and the power source connecting portions 1320 at the electric wiring substrate 1300 side of the recording element unit 1000 are electrically connected via wire harnesses 2130.

(2) Combination of Recording Element Unit with Drive Circuit Substrate Unit

As illustrated in FIGS. 1A, 1B, and 1C, the recording head 100 is a combination of the recording element unit 1000 and the drive circuit substrate unit 2000, and the combination is performed as described below.

First, the drive circuit substrate unit 2000 is supported and fixed with screws on the supporting members 1400 and 1405 provided on both ends with respect to longitudinal direction of the recording element unit 1000, which is positioned on an opposite side to the discharge surface, on which the recording element substrate 1100 is provided, of the recording element unit 1000.

Figure 9:
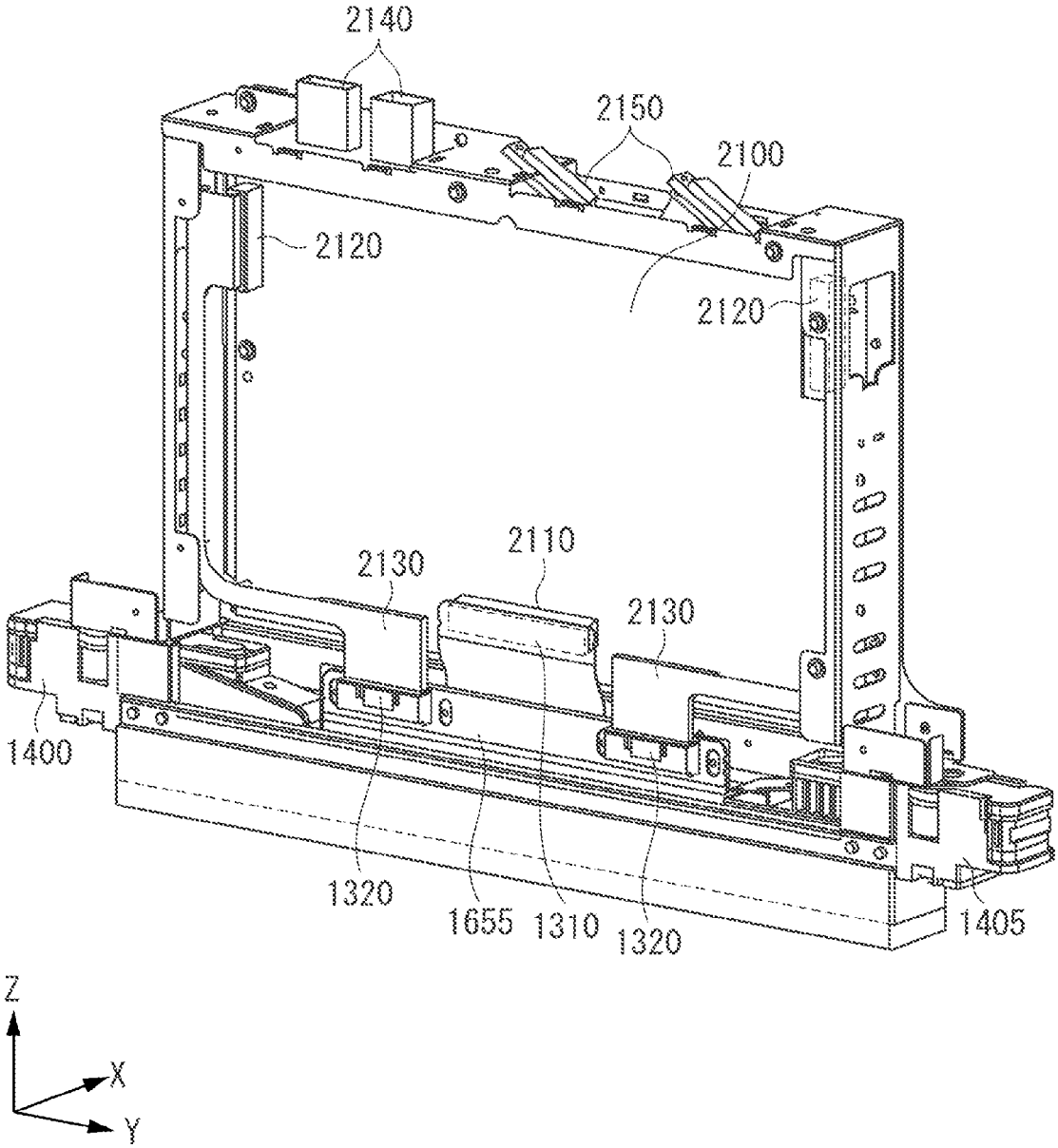
FIG. 9 is a perspective view illustrating a state in which the recording element unit and the drive circuit substrate unit are assembled.

Then, as illustrated in FIG. 9, the wire harnesses 2130 connected to the drive circuit substrate 2100 are connected to the power source connecting portions 1320 attached to the electric wiring substrate 1300 of the recording element unit 1000.

The vicinities of the power source connecting portions 1320 of the recording element unit 1000 are secured to a wiring substrate securing portion 1655 formed integrally with the side plate 1650 (see FIG. 1C). The wiring substrate securing portion 1655 is secured to the supporting members 1400 and 1405 of the recording element unit 1000.

As illustrated in FIGS. 1A, 1B, and 1C, the drive circuit substrate unit 2000 is covered by the cover 2300. The recording element unit 1000 and the drive circuit substrate unit 2000 are combined, and become a state where there is little or no clearance between the recording element unit 1000 and the drive circuit substrate unit 2000.

(3) Inkjet Recording Apparatus

Figure 10:
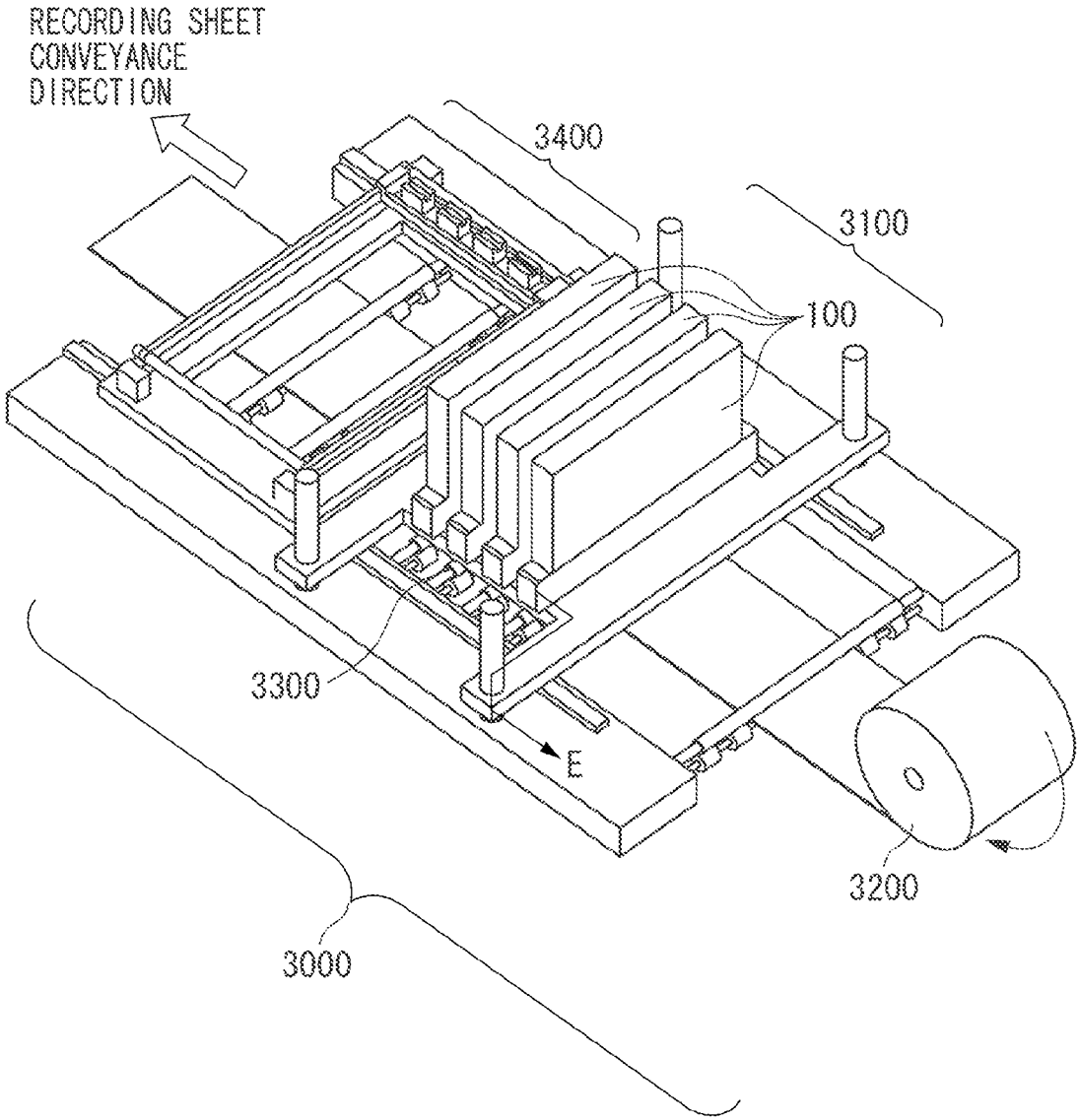
FIG. 10 is an explanatory view illustrating a configuration of the recording apparatus.

FIG. 10 illustrates a configuration of the recording apparatus 3000 according to the exemplary embodiment of the present invention. The recording apparatus 3000 is a line printer that performs recording, while continuously conveying a recording sheet 3200 as a recording medium in a conveyance direction ("X" direction illustrated in FIG. 9), using a long full-line type recording head 100.

The recording apparatus 3000 includes a holder (not illustrated) for holding the recording sheet 3200 wound in the form of roll, a conveying mechanism 3300 for conveying the recording sheet 3200 in the "X" direction at a predetermined speed, and a recording unit 3100 for performing recording on the recording sheet 3200 using the recording head 100. The recording sheet 3200 is not limited to the continuous roll sheet, and cut sheets may be used.

Moreover, the recording apparatus 3000 is provided with an ink tank (not illustrated) for containing ink to be supplied to the recording head 100. In the recording unit 3100, a plurality of recording heads 100 each corresponding to different ink colors are provided in parallel. In the present exemplary embodiment, four recording heads 100 corresponding to four colors of cyan, magenta, yellow, black are used, but a number of colors and a type of colors are not limited thereto.

Figure 11A:
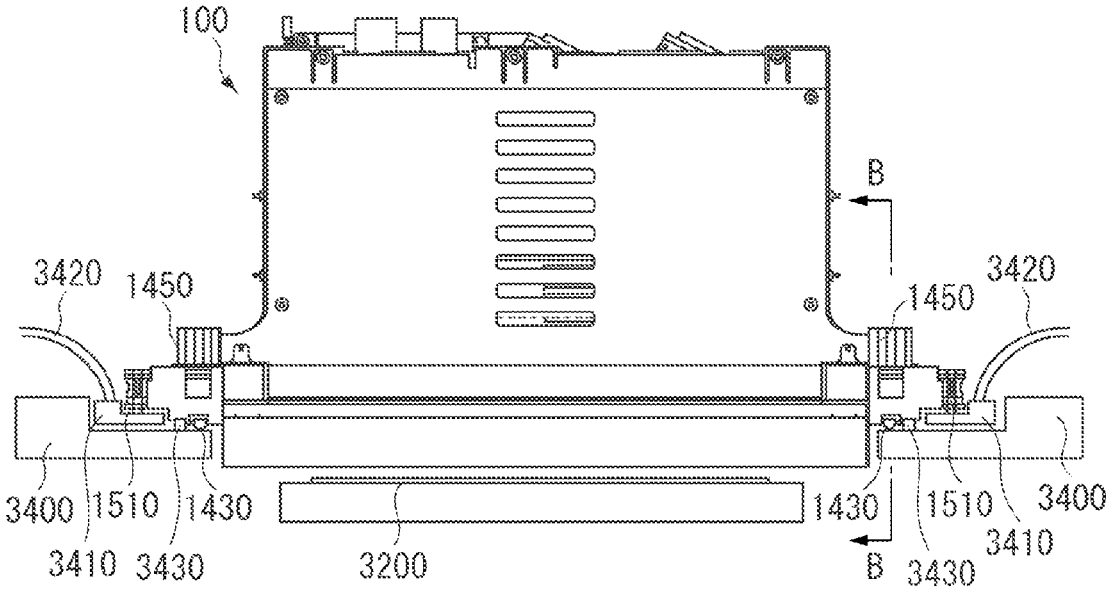
Figure 11B:
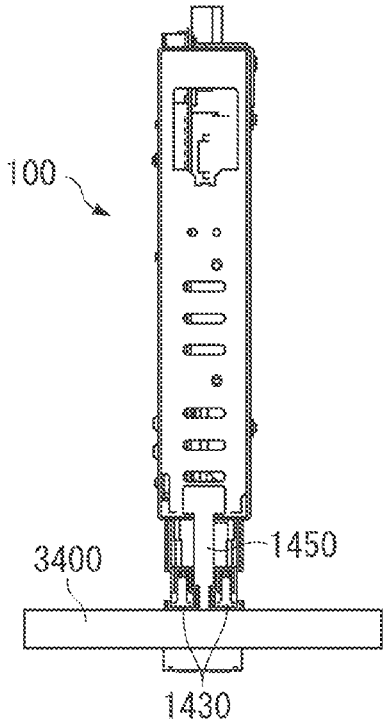

FIGS. 11A and 11B illustrate a state where the recording head 100 is mounted on the recording apparatus 3000. The connecting portions 1510 provided at both ends with respect to the longitudinal direction of the recording head 100 are connected to the connecting units 3410 of the recording apparatus 3000. In the connected portions, the ink is entered into the recording head 100, and the ink is output from the recording head 100. Each of the inks for respective colors is supplied to the recording head 100 via ink tube 3420 from the ink tank.

The positioning holes 1410 and 1415 (see FIGS. 6A and 6B) arranged in the inner side of the connecting portions 1510 with respect to the longitudinal direction of the recording head 100 are fit with the positioning pins 3430 of the head holders 3400. The positioning portions 1430 of the recording head 100 are abutted against the head holders 3400, thereby performing positioning of the recording head 100 relative to the recording apparatus 3000.

The supporting members 1400 and 1405 provided at the both ends of the recording head 100 are secured and held to the recording apparatus 3000 by head securing bolts 1450.

(First Exemplary Embodiment)

Hereinbelow, the main part of the present invention will be described. Noise sources in the inkjet recording apparatus 3000 mainly include the recording medium (the recording sheet 3200), and the conveying mechanism 3300 (especially, conveyance rollers 3310 and 3320) at the time of conveyance.

More specifically, static electricity is generated due to friction between the recording sheet 3200 and the conveyance rollers 3310 and 3320, or friction between shafts and bearings of the conveyance rollers 3310 and 3320. If the static electricity is discharged to the wiring for signals of the electric wiring substrate 1300, there is a risk that noise is generated. Therefore, it is desirable to separate or shield the electric wiring substrate 1300 from these noise sources.

However, especially in the case where the recording apparatus 3000 is a line printer, the line printer has the recording heads 100 for a plurality of colors, and the conveyance rollers 3310 and 3320 are provided between the recording heads 100. As a result, the electric wiring substrate 1300 may be close to the noise sources.

The reasons why the conveyance rollers 3310 and 3320 are provided between the recording heads 100 include as follows:

[1] Since a plurality of the recording heads 100 for different colors are provided in parallel in a conveyance direction of the recording medium, an overall width of the recording unit 3100 (FIG. 10) with respect to the conveyance direction becomes wider, and a risk of cockling (waving phenomenon of the recording medium) increases.

[2] In particular, if a roll-paper is used as the recording medium, there is a risk that influence of cockling becomes remarkable, since a paper sheet has a curling tendency.

[3] For the line printer, a larger amount of ink adheres to the recording medium in a short time in comparison with a serial printer, and as a result, possibility that cockling may occur due to the moisture increases.

Also, when the influence of cockling in [3] is taken into consideration, it is desirable to perform recording in a short time. Therefore, it is preferable to arrange the recording heads 100 with as narrow intervals as possible therebetween. Moreover, by making the intervals between the recording heads 100 narrow, it is also possible to reduce the size of the recording apparatus 3000.

As described above, it is obvious that a configuration in which the conveyance rollers 3310 and 3320 are provided between the recording heads 100 of the line printer, leads to a configuration in which the noise sources and the electric wiring substrate 1300 are positioned close to each other.

The present inventors have thought, as measures against these noises, to cope with the situation by a configuration for shielding the electric wiring substrate 1300 with a shield member. By providing the shield member, static electricity which becomes a cause of the generation of noise can be dispersed within the shield member. Accordingly, a risk that the static electricity is discharged to the electric wiring substrate 1300 to generate the noise can be reduced, and a risk of degraded image quality resulting from the generation of noise can be suppressed.

However, if the shield member is provided on the discharge surface side which coincides with a surface on which the recording element substrate 1100 of the recording element unit 1000 is disposed, there is a possibility that a distance between the discharge surface and the recording medium (hereinafter, referred to as a "head-to-paper distance") is widened.

In order not to reduce accuracy of impact position of the ink onto the recording medium, it is preferable not to widen the head-to-paper distance. For this reason, in the present exemplary embodiment, employed is a configuration for shielding the electric wiring substrate 1300 disposed on a side surface of the recording head 100, except for the discharge surface side, with the side plate 1600, and the side plate 1650 serving as the shield member.

Figure 12:
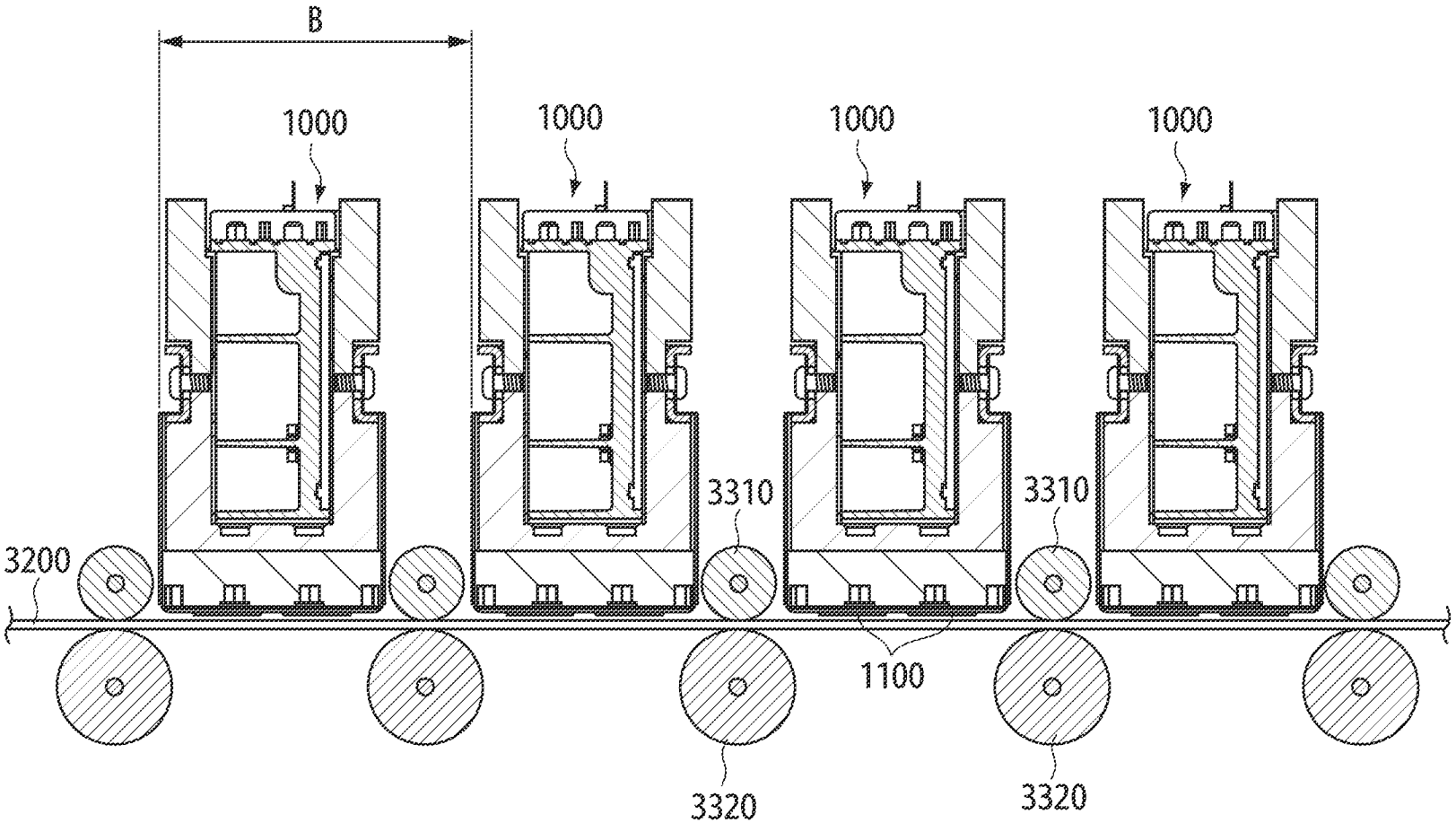
FIG. 12 is a schematic cross-sectional view illustrating the recording head of a recording portion of the recording apparatus illustrated in FIG. 10, with respect to a narrow side direction.
Figure 13:
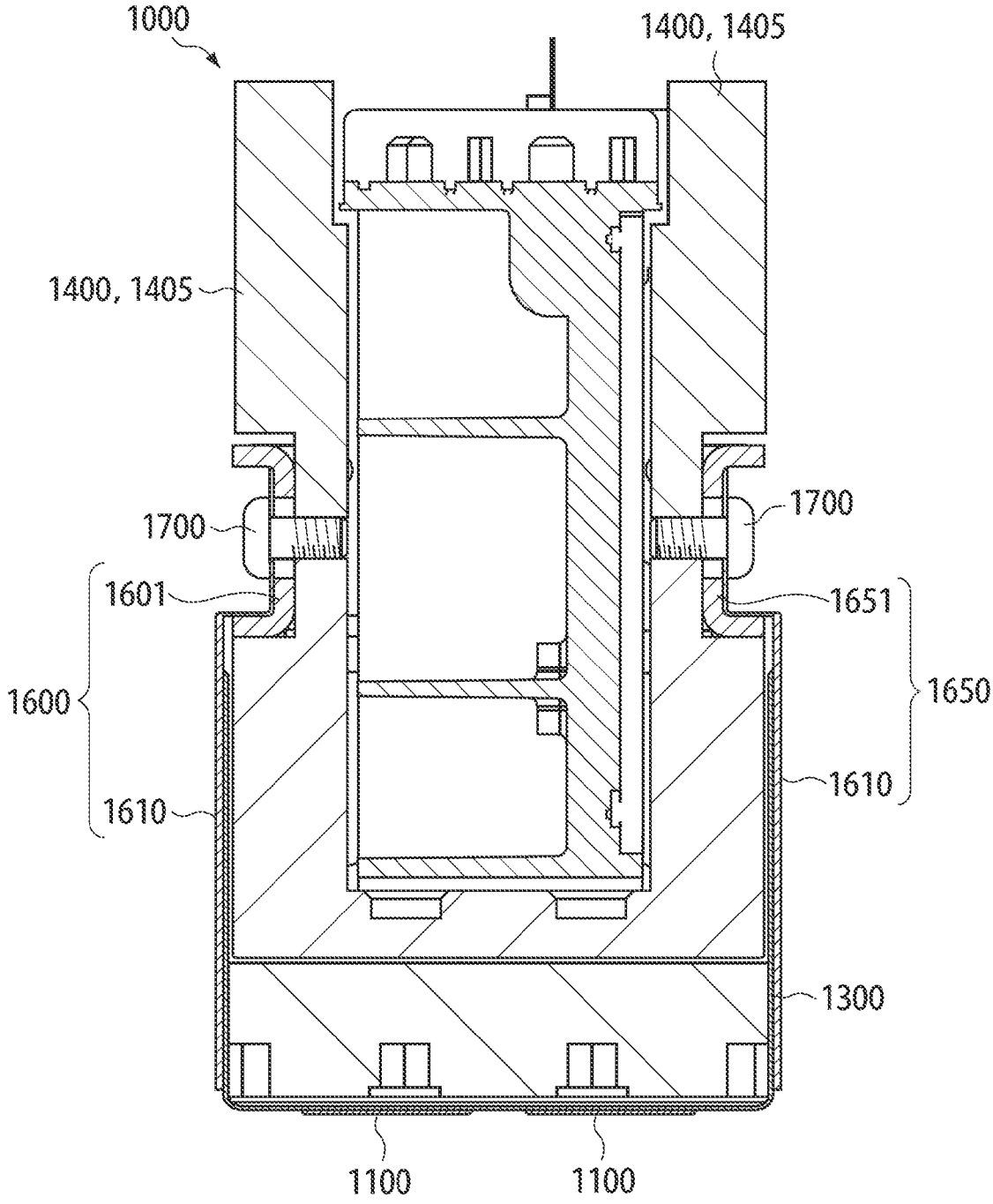
FIG. 13 is a schematic cross-sectional view of the recording element unit illustrated in FIG. 12.

Hereinafter, with reference to FIG. 12 to FIG. 16, the main part of the present exemplary embodiment will be described in detail. FIG. 12 is a schematic cross-sectional view illustrating the recording head of a recording portion of the recording apparatus illustrated in FIG. 10, with respect to a narrow side direction. FIG. 13 is a schematic cross-sectional view of the recording element unit 1000, illustrated in FIG. 12.

Figure 14A:
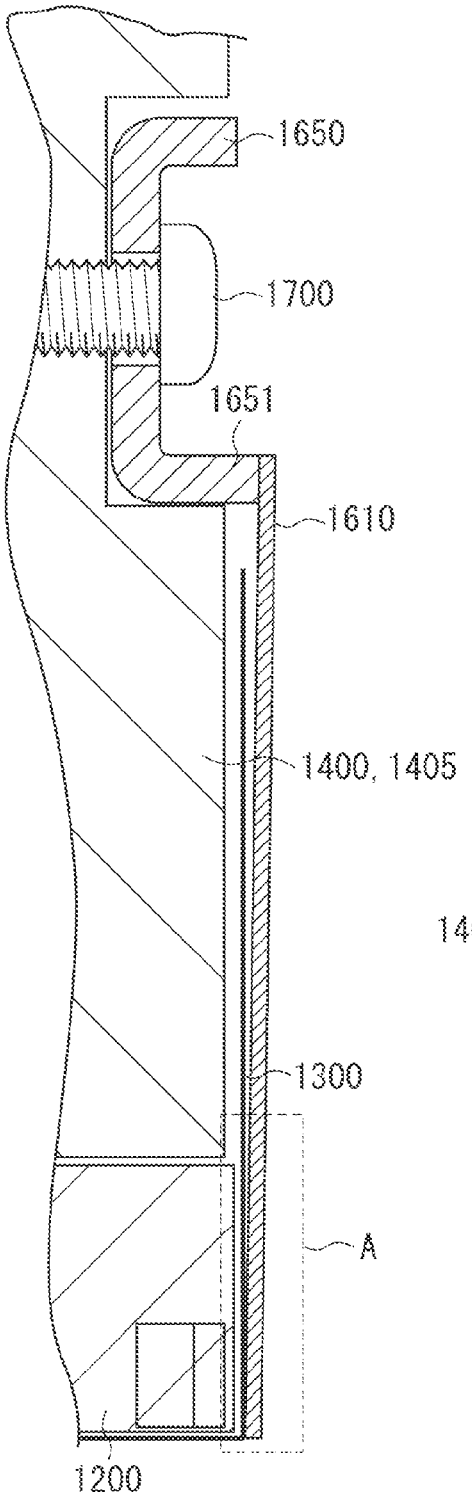
Figure 14B:
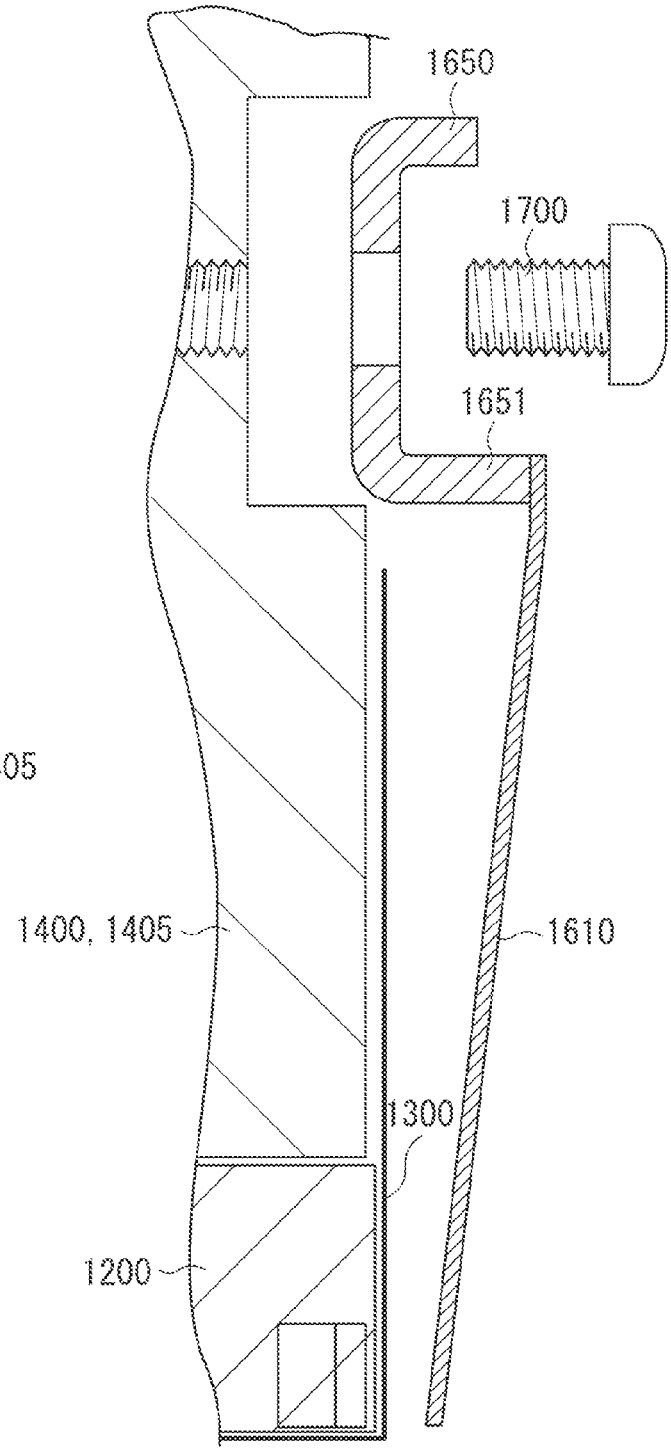
FIG. 14B illustrates a state before the side plate is attached.

FIG. 14A is a schematic view of the vicinity of the side plate 1650 of the recording element unit 1000 illustrated in FIG. 13, and illustrates a cross-sectional view of the recording element unit 1000 viewed from the lateral direction thereof. FIG. 14B is an exploded view illustrating the recording element unit 1000 corresponding to that in FIG. 14A in a state before the side plate 1650 is attached.

The recording unit 3100 of the recording apparatus 3000 according to the present exemplary embodiment is provided with a plurality of the recording heads 100 each corresponding to different ink colors. As illustrated in FIG. 12, a first conveyance roller 3310 and a second conveyance roller 3320 are arranged at the front and back of the recording head 100 (the recording element unit 1000) along the conveyance direction of the recording sheet 3200.

The recording sheet 3200 is sandwiched between the two conveyance roller 3310 and 3320, and rotations of the first conveyance roller 3310 and the second conveyance roller 3320 exert a sheet conveying force to the recording sheet 3200.

Moreover, the two conveyance rollers 3310 and 3320 have a role to suppress cockling of the recording sheet 3200 and to keep a constant distance between the recording element substrate 1100 of the recording head 100 and the recording sheet 3200.

As described above, in the present exemplary embodiment, two side plates 1600 and 1650 as constituent members of the recording element unit 1000 are formed of a material having electric conductivity, and are used as the shield member for the electric wiring substrate 1300 which is a flexible wiring substrate. A configuration of the side plate 1600 and the side plate 1650 will be described with reference to FIG. 2.

The two side plates 1600 and 1650 are thin plate-like members covering the side surface along the longitudinal direction of the recording head 100. The side plate 1600 is formed by welding a plate-like side panel 1610 to a rod-like base bar 1601. The side plate 1650 is constituted by the plate-like side panel 1610 being welded to the rod-like base bar 1651. The plate-like wiring substrate securing portion 1655 for securing the peripheries of the power source connecting portions 1320 of the electric wiring substrate 1300 is integrally formed with the rod-like base bar 1651.

As illustrated in FIG. 13, the two side plates 1600 and 1650 are provided so as to shield the surface of a portion disposed on the side surface in the longitudinal direction of the recording element unit 1000, of the electric wiring substrate 1300, and are secured to the two supporting members 1400 and 1405.

The side panel 1610 and the base bars 1601 and 1651 constituting the two side plates 1600 and 1650 are composed of a material having electric conductivity, and the side plates 1600 and 1650 as a whole are configured to have electric conductivity.

In the present exemplary embodiment, for reasons such as higher electric conductivity, resistant to ink induced corrosion, degree of freedom in shapes, inexpensive, high rigidity, and resistant to deterioration over time, the both the side plates 1600 and 1650 are formed of stainless steel (SUS).

In the present exemplary embodiment, since it is only necessary to reduce a risk that static electricity is discharged to the electric wiring substrate 1300, it is only necessary, as a material of the side plates 1600 and 1650, to use a material with higher electric conductivity than that of a film constituting the electric wiring substrate 1300.

The plate-like side panel 1610, and the rod-like base bars 1601 and 1651 maybe constructed with different materials, as long as they have electric conductivity. Further, as long as both members are constructed to be electrically conductive, the both members may be joined with different means such as screwing. Moreover, the side panel 1610 and the base bars 1601 and 1651 may be integrally formed as one-piece member.

As described above, in the present exemplary embodiment, the electric wiring substrate 1300 provided on the side surface along the longitudinal direction of the recording element unit 1000, is shielded with the side plates 1600 and 1650. Accordingly, static electricity responsible for the generation of noise can be dispersed within the side plates 1600 and 1650. As a result, it is possible to reduce a risk that static electricity is discharged to the electric wiring substrate 1300 to thereby generate noise, and in addition, to suppress a risk of degraded image quality due to the generation of noise.

In order to suppress a risk of static electricity discharge from the conveyance rollers 3310 provided on the recording head 100 side, it is only necessary that the side plates 1600 and 1650 are provided at least to a height enough to face the conveyance rollers 3310. From viewpoint of dispersing charges of the static electricity, it is more desirable that the side plates 1600 and 1650 have greater surface area.

As illustrated in FIG. 12, in the present exemplary embodiment, the conveyance rollers 3310, which become noise sources, are provided near the end portions of the discharge surface side of the recording element unit 1000. For this reason, the shield members are not provided on the discharge surface side of the recording element unit 1000. Moreover, if there is a gap between the end portion on the discharge surface side of the side plates 1600 and 1650 and the electric wiring substrate 1300, there is a risk that electric charge invades from the clearance.

Figure 16:
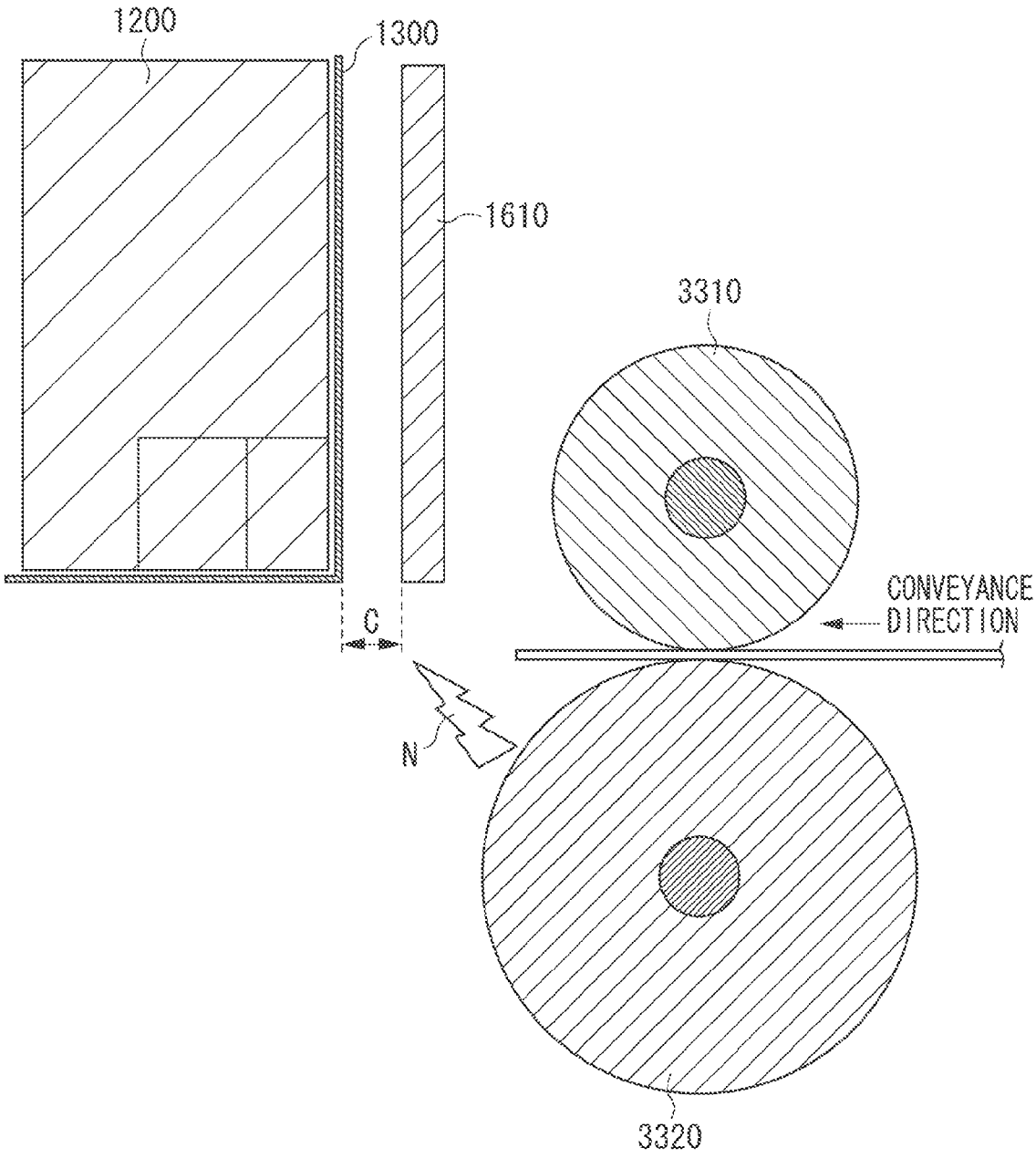
FIG. 16 is an explanatory view illustrating a state where the electric wiring substrate and a side-plate are not in intimate contact with each other.

More specifically, as illustrated in FIG. 16, if there is a gap C between the electric wiring substrate 1300 and the side panel 1610, on the recording sheet 3200 side or the second conveyance roller 3320 side, electric charge N of the static electricity is discharged to the electric wiring substrate 1300, and there is a risk of the generation of noise.

For this reason, as illustrated in a region "A" surrounded by dashed lines in FIG. 14A, in the vicinity of the end portion of the discharge surface side of the recording element unit 1000, it is preferable that the side panel 1610 and the electric wiring substrate 1300 are in intimate contact with each other. In the present exemplary embodiment, plate spring members (elastic member) are used as the side plates 1600 and 1650.

On the side surface along the longitudinal direction of the base plate 1200, the side panel 1610 urges in a pressing direction of the electric wiring substrate 1300 by elasticity of the side panel 1610, and thereby both are kept in intimate contact with each other. Accordingly, a risk of invasion of electric charge from the gap between the end portion on the discharge surface side of the side plates 1600 and 1650, and the electric wiring substrate 1300 can be reduced, and influence of noise can be reduced in comparison with the case where there is the gap between the side plates 1600 and 1650 and the electric wiring substrates 1300.

A configuration for restraining the gap to be provided between the end portion at the discharge surface side of the side plates 1600 and 1650 and the electric wiring substrates 1300, is not limited to the configuration for using plate spring member as the side plates 1600 and 1650, as described above.

A configuration of bonding the side plates 1600 and 1650, and the electric wiring substrate 1300 using adhesives may be used. However, since manufacturing process thereof is easier than that when adhesive is used, and there is no risk that a width along the lateral direction of the recording head 100 thereof becomes greater like when adhesive is used, the use of the plate spring member is more desirable.

As illustrated in FIGS. 13, 14A, and 14B, the side plates 1600 and 1650 are secured to the supporting members 1400 and 1405 with screws 1700. If a configuration for securing the side plates 1600 and 1650 to the base plate 1200 with the screws is employed, the screws will protrude in a direction of adjoining recording heads 100. Thus, a configuration in which a part of each of the supporting members 1400 and 1405 is recessed so that the screws 1700 fall within a width in the lateral direction of the base plate 1200 is employed (see FIG. 14A). By employing such a configuration, a risk of an increased width along the lateral direction of the recording head 100 can be reduced.

Moreover, a width dimension of the supporting members 1400 and 1405 is set so as to fall within a width in the lateral direction of the base plate 1200. Accordingly, within the region "A" of the side surface (see FIG. 14A) in the longitudinal direction of the base plate 1200, the electric wiring substrate 1300 and the side panel 1610 can be surely brought into intimate contact with each other.

Further, if a configuration for providing the conveyance rollers 3310 and 3320 between the recording heads 100 is employed, there is a risk that a quantity of electrostatic charge of the recording sheet 3200 is increased, as nearer to downstream side of the conveyance direction of the recording sheet 3200, due to friction between the recording sheet 3200 and the conveyance rollers 3310 and 3320.

However, in the present exemplary embodiment, the side plates 1600 and 1650 are provided, and static electricity generated by the friction is more likely to be discharged to the side plates 1600 and 1650 than discharged to the recording element substrates 1100 or the electric wiring substrate 1300. For this reason, by causing static electricity accumulated in the recording sheet 3200 to be discharged to the side plates 1600 and 1650, at a midpoint in the conveyance of the recording sheet 3200, a risk that electric charge is discharged directly to the electric wiring substrate 1300 or the recording element substrates 1100 can be reduced.

In order to reduce the risk that electrical charge borne by the recording sheet 3200 is discharged to the recording element substrates 1100, it is only necessary to provide the side plates so as to shield the electric wiring substrate 1300 disposed on the side surface at upstream side of the recording head 100 along the conveyance direction of the recording sheet 3200.

This is because, by disposing the conductive side plates at this position, the recording sheet 3200 passes through the vicinity of the side plates, immediately after the recording sheet 3200 has been brought into frictional contact with the conveyance rollers 3310 and 3320, and before being conveyed to a position facing the recording element substrates 1100.

Further, in the line printer using the full-line type recording head 100, as described in the present exemplary embodiment, the recording head 100 is secured, and dedicated sheet is used as the recording sheet 3200 for use, in many cases.

Since the sheet thickness is even, interference between the recording head 100 and the sheet hardly occurs, and in order to improve an accuracy of impact position of the ink to the recording sheet 3200, the head-to-paper distance between the recording head 100 and the recording sheet 3200 can be made small (e.g., about 0.8 mm). When the head-to-paper distance is made small, the recording head 100 will come close to the conveyance rollers 3320 and the recording sheet 3200, which become noise sources, and as a result, there is a risk that influence of noise to the recording head 100 becomes large.

For this reason, in such a case, as described in the present exemplary embodiment, a configuration for shielding the side surface in the longitudinal direction of the recording element unit 1000 with the side plates 1600 and 1650 becomes more effective.

Moreover, in the full-line type recording head, more rapid data transfer rate is required for simultaneously driving many electrothermal conversion elements 1102, in comparison with a serial type recording head. When fast data transfer rate is performed, radiation noise generated from the electric wiring substrate 1300 of the recording heads 100 increases, and as a result, there is a risk that malfunction occurs due to radiation noise on adjoining recording heads 100.

Shielding effect can be obtained even against the radiation noise from such adjoining recording heads 100, by providing the side plates 1600 and 1650, and a risk of malfunction of the adjoining recording heads 100 can be reduced.

Figure 15A:
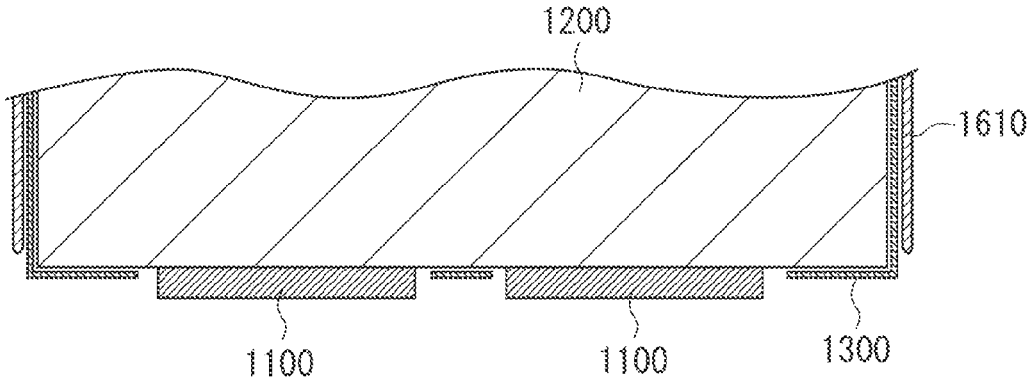
Figure 15B:
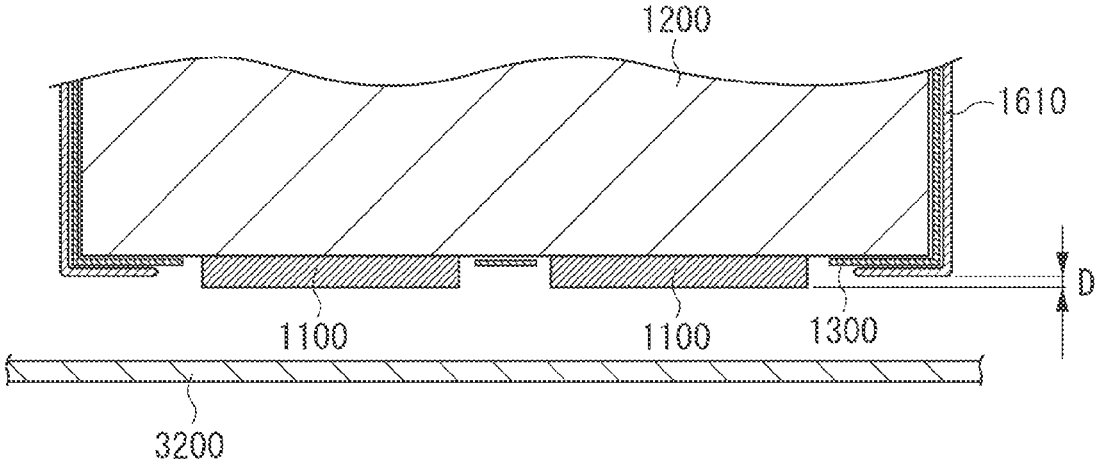

In the present exemplary embodiment, as illustrated in FIG. 15A, a configuration in which the side panel 1610 of the side plates shields the discharge surface side of the recording element unit 1000 up to its edge is employed. By employing such a configuration, a risk of electrical charges borne by the recording sheet 3200 or the conveyance rollers 3310 and 3320 to be discharged directly to the electric wiring substrate 1300, can be further reduced. Further, if within a range which does not give influence to the head-to-paper distance, a configuration illustrated in FIG. 15B can be also employed.

More specifically, by bending the side panel 1610 along the electric wiring substrate 1300, the side panel 1610 can be arranged even on the discharge surface on which the recording element substrate 1100 of the recording element unit 1000 is mounted. In this case, it is desirable to arrange the side panel 1610 in such a manner that heights of the side panel 1610 and the discharge surfaces of the recording element substrate 1100 are aligned to avoid the head-to-paper distance from being widened, or a predetermined gap "D" is secured on the base plate 1200 side of the discharge surface.

In the present exemplary embodiment, the electric wiring substrate 1300 is bent along both the side surfaces in the longitudinal direction of the recording element unit 1000. However, a configuration in which the electric wiring substrate 1300 is bent along the one side surface may be employed.

In the present exemplary embodiment, the side plates 1600 and 1650 are electrically conductive to a ground of the recording apparatus 3000. Hereinafter, the details will be described, however, similar configuration to that in the above-described exemplary embodiment will not be repeated.

The recording head 100 according to the present exemplary embodiment is configured in such a manner that the supporting members 1400 and 1405 (electric conductivity members) are formed of material having electric conductivity, and both members are joined so as to be electrically conductive with the side plates 1600 and 1650 illustrated in the first exemplary embodiment.

Various types of materials can be used as the material having electric conductivity. Because aluminum material has relatively high conductivity, high degree of freedom of shapes, inexpensiveness, high rigidity, and lightness in weight, the aluminum material is used as the material of the supporting members 1400 and 1405 according to the present exemplary embodiment. Further, the supporting members 1400 and 1405, and the side plates 1600 and 1650 are joined together by means of screwing, and the both members are electrically conductive to each other.

The supporting members 1400 and 1405 may be made of different materials if they are materials having conductivity, and may be joined by means other than screwing as long as they are electrically conductive to the side plates 1600 and 1650.

Moreover, in the present exemplary embodiment, a configuration in which the supporting members 1400 and 1405, and the ground of the recording apparatus 3000 are electrically conductive to each other, is employed. More specifically, the positioning portions 1430 provided on the supporting members 1400 and 1405, and the head holders 3400 (see FIG. 11 for both) of the recording apparatus 3000 are formed of a metallic material having electrical conductivity, and the head holders 3400 are caused to be electrically conductive to the ground of the recording apparatus 3000.

Accordingly, by mounting the recording head 100 on the head holders 3400, the side plates 1600 and 1650 are made to be electrical conductive to the ground of the recording apparatus 3000, along a route indicated by an arrow "E" in FIG. 10, and are grounded thereto.

In this way, the present exemplary embodiment employs a configuration in which the side plates 1600 and 1650 are made to be electrically conductive to the ground of the recording apparatus 3000. For this reason, if electrical charges borne by the conveyance rollers 3310 and 3320 or the recording sheet 3200, are electrically discharged to the side plates 1600 and 1650, the electrical charges flow from the side plates 1600 and 1650 via the supporting members 1400 and 1405 to the ground of the recording apparatus 3000. Therefore, a risk of the generation of noise due to static electricity discharge to the recording head 100 can be further reduced.

Although the above-described exemplary embodiment has been described using a line printer as an example on which a full-line type recording head 100 is installed, the configuration of the present invention is not limited to the line printer.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-112363 filed May 14, 2010, which is hereby incorporated by reference herein in its entirety.

What is claimed is:

1. A liquid discharge head comprising:

a recording element substrate including a recording element that generates energy for discharging liquid from a discharge port;

a base plate including a mounted surface on which the recording element substrate is mounted;

an electric wiring substrate including a portion disposed on another surface of the base plate different from the mounted surface, adjacent to the mounted surface, and configured to be electrically connected to the recording element substrate; and a shield member having electric conductivity and configured to shield the portion.

2. The liquid discharge head according to claim 1 comprising, an electric conductive member having electric conductivity, and the shield member is grounded via the electric conductive member.

3. The liquid discharge head according to claim 2, wherein the electric conductive member is a supporting member that supports the base plate.

4. The liquid discharge head according to claim 1, wherein the portion is disposed to an end portion, of the another surface, adjacent to the mounted surface, and the portion and the shield member are brought into intimate contact in the vicinity of the end portion.

5. The liquid discharge head according to claim 4, wherein the shield member is an elastic member having elasticity, and the portion and the shield member are brought into intimate contact in the vicinity of the end portion by the shield member urging the portion to the base plate by elasticity of the shield member.

6. The liquid discharge head according to claim 1, wherein the electric wiring substrate includes wiring, a film member that covers the wiring, and wherein the shield member has a higher electric conductivity than that of the film member.

7. The liquid discharge head according to claim 1, wherein the electric wiring substrate has wiring for transmitting signals for driving the recording element to the recording element substrate.

8. A liquid discharge apparatus in which a plurality of the liquid discharge heads according to claim 1 are mounted side by side, the liquid discharge apparatus includes a conveying mechanism for conveying a recording medium that receives liquid discharged from the liquid discharge head, disposed to face the shield member.

9. The liquid discharge apparatus according to claim 8, wherein the conveying mechanism is provided between the liquid discharge heads adjoining to each other, and wherein the portion shielded by the shield member is disposed at least at upstream side of the liquid discharge head along a direction in which the recording medium is conveyed with the conveying mechanism.

* * * * *